United States Patent [19]

Cunningham

[11] 4,149,631

[45] Apr. 17, 1979

[54] VARIABLE BAND WIDTH PLASTIC MULTI-PACKAGING DEVICE

[75] Inventor: Ernest R. Cunningham, Libertyville, Ill.

[73] Assignee: Grip-Pak Systems, Inc., Cape Girardeau, Mo.

[21] Appl. No.: 879,259

[22] Filed: Feb. 21, 1978

[51] Int. Cl.[2] ..... B65D 71/00

[52] U.S. Cl. ..... 206/150; 206/158; 206/161; 53/48; 294/87.2

[58] Field of Search ..... 206/150, 151, 158, 161; 294/87 R, 87.2; 53/48

[56] References Cited

U.S. PATENT DOCUMENTS

| | | | |
|---|---|---|---|
| 3,199,908 | 8/1965 | Poupitch | 206/151 |
| 3,269,530 | 8/1966 | Wanderer | 206/150 |
| 3,608,949 | 9/1971 | Owen | 206/150 |
| 3,733,100 | 5/1973 | Tanzer | 206/150 |
| 3,778,096 | 12/1973 | Smith | 294/87.2 |
| 3,874,502 | 4/1975 | Weaver | 206/150 |

*Primary Examiner*—Herbert F. Ross
*Attorney, Agent, or Firm*—Michael Kovac

[57] ABSTRACT

A multi-packaging device formed from stretchable and elastic plastic sheet material is disclosed as having a plurality of attached bands each including inner and outer curvilinear band sections wherein at least the outer curvilinear band sections thereof have a variable or tapering band width.

5 Claims, 3 Drawing Figures

VARIABLE BAND WIDTH PLASTIC MULTI-PACKAGING DEVICE

SUMMARY OF THE INVENTION

Stretchable and elastic plastic sheet multi-packaging devices which are formed from an unsupported sheet of resilient, elastic and deformable material such as low density polyethylene are well known in the art as shown from expired U.S. Pat. No. 2,874,835. Such multi-packaging devices are widely and successfully utilized in the packaging of a plurality of containers to form 6-pack, 8-pack and other multi-package sizes.

In the assembly of such multi-packaging devices to containers, the connected bands of the multi-packaging device are stretched and deformed such that the bands form embracing collars for gripping and holding containers. Where the bands are stretched and deformed by a moving pair of opposed semi-circular jaws, which have an included angle less than 180°, as typified by the mechanisms shown in U.S. Pat. Nos. 3,032,943; 3,032,944; 3,221,470; 3,774,935 and 3,816,968, a frictional force develops between the contact surfaces of the band and the semi-circular jaws. The friction force that is transferred to the bands varies along the band-/jaw contact face since the force gradient begins at the initial contact point between the jaw ends (or ends of the circular arc of contact between the band and jaw) and builds to a maximum at the midpoint of the circular arc of contact between the band and jaw. Thus, the frictional force that develops is cumulative during elongation or stretching of the bands and reaches maximum at the point of maximum lateral band width (generally corresponding to the midpoint of the semi-circular jaws).

On the other hand, the tension in the band, at the midpoint of the circular arc of contact between the band and jaw, is at a minimum and is equal to the tension in the band without band/jaw contact less the frictional force that accumulates through one-half the jaw arc contact. The frictional and tensional forces have the net effect of causing unequal forces to be transmitted to the band, hence causing unequal stresses to result where a constant width band design is used. The result is the "necking down" phenomenon at the ends of the jaw/band contact.

It is desirable to control and establish uniform elongation throughout the band width to avoid "necking down" which is a narrowed and overstretched portion of the bands. When a band is "necked down", the gripping and holding characteristic of the stretched and deformed bands is greatly minimized or lost, thus resulting in poor can retention in the multi-pack.

Regretably, "necked down" bands are a common phenomenon that occur with present designs, such as those shown in U.S. Pat. Nos. 2,874,835; 3,711,145; 3,733,100 and 3,874,502, as well as other multi-pack designs.

With present designs, the frictional force that develops between the bands and semi-circular jaws, as the band elongates results in localized elongation of band sections.

Accordingly, it is an object of the present invention to provide a plastic multi-packing device which eliminates the aforementioned "necking down" phenomenon.

More specifically, it is an object of the present invention to provide a plastic multi-packaging device which provides uniform stress loading during elongation to overcome the aforementioned deficiencies of prior art designs.

These and other objects and advantages of the herein disclosed plastic multi-packaging device will become apparent from the ensuing discussion.

DESCRIPTION OF THE PREFERRED EMBODIMENTS

Figure 1:
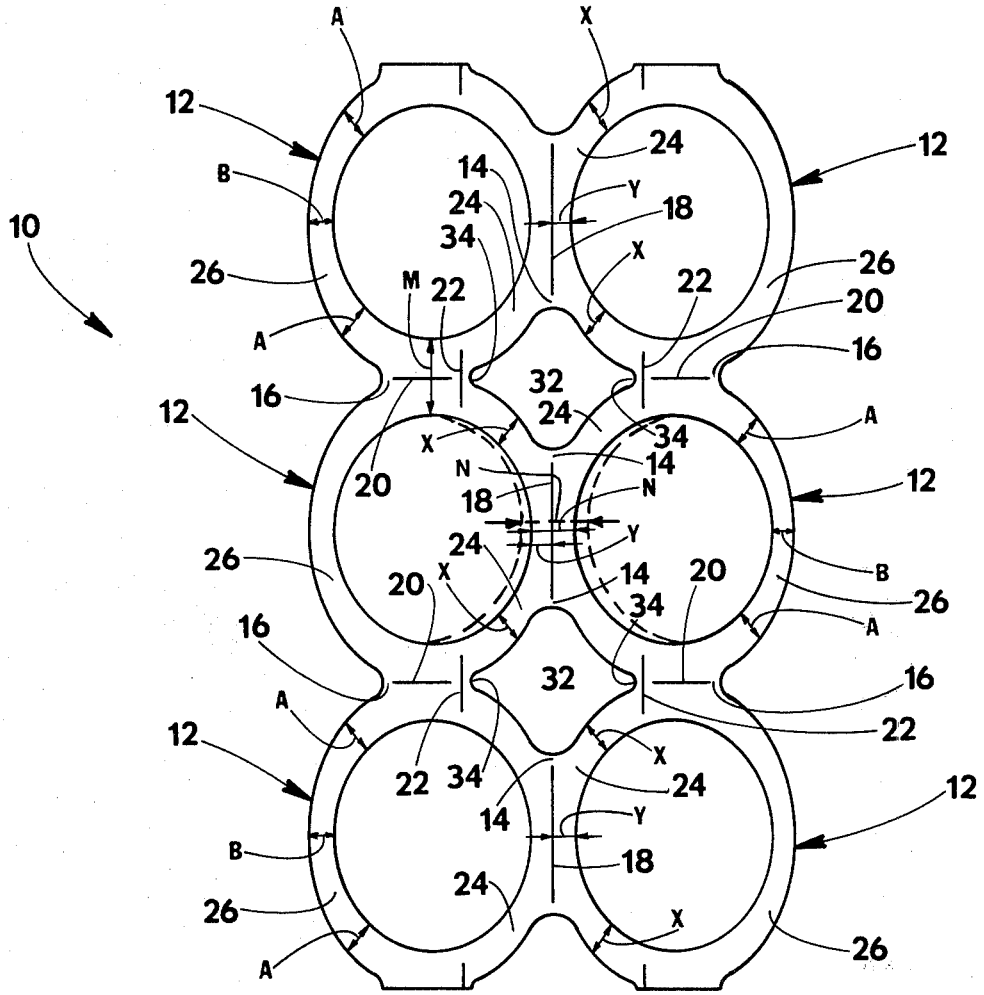
FIG. 1 is a top plan view of a plastic multi-packaging device that is constructed in accordance with the teachings of the present invention.

In the description that is to follow, it will be understood that the term "stretchable and elastic plastic sheet material" includes resilient, elastic and deformable plastic material such as low density polyethylene or other equivalent material; the term "container" includes can and bottle products of any size or shape; and the term "package" or "multi-package" includes a plurality of containers held together by a stretchable and elastic plastic sheet multi-packaging device to form a 6-pack, 8-pack or the like.

The stretchable and elastic plastic sheet multi-packaging device 10, shown in the drawing as a 6-pack configuration, includes a plurality of bands 12 which are arranged in longitudinal rows and which are joined to adjacent bands 12 between the longitudinal rows by lateral connecting webs 14 while being joined to adjacent bands 12 in each longitudinal row by longitudinal connecting webs 16. The bands 12 are generally elliptical in configuration with the major or longitudinal axes thereof being longitudinally aligned with adjacent bands 12 in each longitudinal row. The minor or lateral axes of adjacent pairs of generally elliptically shaped bands 12 in the adjacent longitudinal rows are transversely aligned with one another.

To facilitate assembly of the multi-packaging device 10 to containers, the lateral connecting webs 14 have a longitudinal fold line or weakened line 18 therein while the longitudinal connecting webs 16 have a lateral fold line or weakened line 20 therein as well as a longitudinal fold line or weakened line 22 which also extends across adjacent bands 12 as shown. These features enable plastic multi-packaging carriers to be assembled to containers in accordance with the assembly method disclosed and claimed in my copending patent application Ser. No. 845,895 filed Oct. 27, 1977 and entitled "PLASTIC SHEET BAND MULTI-PACKAGING DEVICE AND METHOD OF ASSEMBLING SAME TO CONTAINERS."

With the progressive assembly of plastic multi-packaging devices to containers as disclosed in my aforementioned copending application, there is little opportunity for unequal stresses to be applied to the bands; however, where there is a moving pair of opposed semi-circular jaws for expanding each band, as shown, for example, in U.S. Pat. Nos. 3,032,943; 3,032,944; 3,221,470; 3,775,935 and 3,816,968, unequal forces are applied to the bands causing unequal stresses and the potential "necking down" phenomenon referred to above.

Unequal forces are applied to the plastic bands by the moving pair of opposed semi-circular jaws due to the varying frictional force that develops along the circular arc of contact between each band and jaw. As explained above, the frictional force varies along the band/jaw contact face since the force gradient begins at the initial contact point between the jaw ends (or ends of the circular arc of contact between the band and jaw) and cumulatively increases during elongation or stretching of the bands to a maximum at the point of maximum lateral band width (generally corresponding to the mid-point of the semi-circular jaws). Since the band portion that is engaged by an expanding jaw, over the circular arc of contact therebetween, is under a lower stress than the remaining portions of the band, they elongate less than the remaining portions of the band. It will be apparent, therefore, that a narrowed and overstretched portion of the plastic bands could develop at the ends of the jaws where contact between the jaws and bands terminate. This is the commonly known "necked down" phenomenon referred to above which results in poor can retention.

In accordance with the present invention, the bands 12 of the multi-packaging device 10 provide uniform stress loading during elongation to overcome the aforementioned deficiences of prior art designs.

In the drawing, it will be seen that each band 12 includes an inner curvilinear band section 24 and an outer curvilinear band section 26. The inner curvilinear band section 24 of each band 12 is integrally attached to a lateral connecting web 14 and which extends between adjacent longitudinal connecting webs 16. The outer curvilinear band section 26 of each band 12 is on the opposite side of the band 12 from the inner curvilinear band section 24 and also extends between adjacent longitudinal connecting webs.

Referring first to the outer curvilinear band section 26 of each band 12, it will be seen that it generally tapers from a maximum width "A" in the vicinity of adjacent longitudinal connecting webs 16 to a minimum width "B" generally equidistant the adjacent longitudinal connecting webs 16. With regard to the inner curvilinear band section 24 of each band 12, it will be seen that it generally tapers from a maximum width "X" in the vicinity of adjacent longitudinal connecting webs 16 to a minimum width "Y" generally equidistant adjacent longitudinal connecting webs 16.

Figure 2:
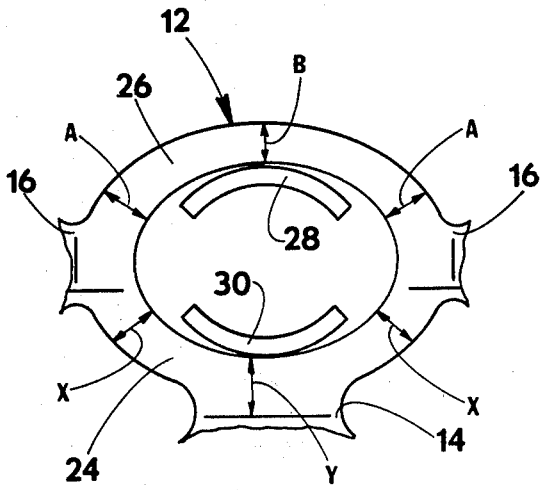
FIG. 2 is an enlarged fragmentary view of one band of the multi-packaging device prior to enlargement thereof.
Figure 3:
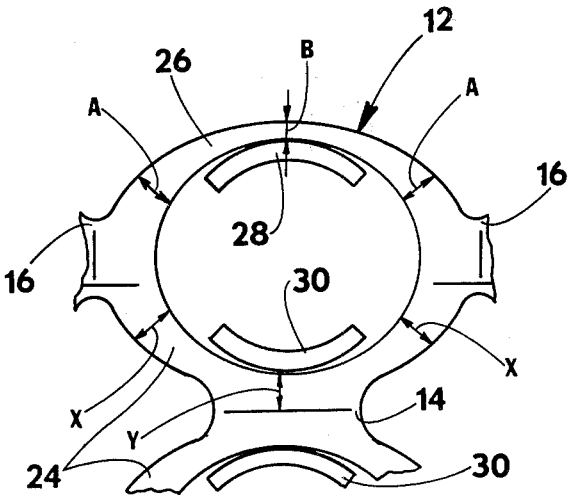
FIG. 3 is an enlarged fragmentary view similar to FIG. 2, but showing the enlarging and tension forces applied to one band of the multi-packaging device.

While certain multi-packaging designs may not require the use of a variable or tapering band width for the inner curvilinear band sections 24, it is necessary that the aforementioned variable or tapering band width be employed for the outer curvilinear band sections 26. This will become apparent by referring the FIGS. 2 and 3 of the drawing where typical examples of semi-circular expanding jaws 28, 30 are shown prior to expansion of the bands 12 as well as during enlargement thereof.

Note that the jaw 28 is arranged to engage the inner margins of the outer curvilinear band section 26 while the jaw 30 is arranged to engage the inner margins of the inner curvilinear band section 24. The variable or tapering band width from "A" to "B" for the outer curvilinear band section 26 is important to compensate for the cumulative friction force generated between the jaw 28 and outer curvilinear band section 26. Similarly, the variable or tapering band width from "X" to "Y" for the inner curvilinear band section 24 compensates for the cumulative friction force generated between the jaw 30 and inner curvilinear band section 24 during enlargement thereof; however, with certain multi-pack designs a uniform band width may be employed for the inner curvilinear band section 24 since the back-to-back arrangement of bands 12 joined by a lateral connecting web 14, together with the length of the lateral connecting web 14, provides additional material for enlargement by the jaw 30. Further, the jaw 30 engaging the inner curvilinear band section 24 is in opposition to a jaw 30 of an adjacent band 12 joined by a lateral connecting web 14. Thus, opposing jaws 30 will exert a compression force on the portions of the inner curvilinear band sections 24 therebetween. As a result, there is less opportunity for unequal stresses to be applied to the inner curvilinear band sections 24 with certain multi-packaging designs.

Where a uniform band width is employed for the inner curvilinear band sections 24 of the bands 12, the width "M" of two adjacent bands 12 in one row in the vicinity of the longitudinal axis of said bands 12 is generally equal to the width "N" of two adjacent bands 12 in each longitudinal row in the vicinity of the lateral axis of the bands 12. In FIG. 1 of the drawings, the width "M" of two adjacent bands in one longitudinal row is greater than "N" or greater than 2 times "Y" (the minimum width of the inner circumferential band section 24) since a tapering band width is also shown for the inner curvilinear band section 24.

In the area between two adjacent pairs of laterally and longitudinally connected bands 12, diamond-shaped openings 32 with rounded end corner portions 34 are provided. A user's fingers may be inserted between adjacent diamond-shaped openings 32 in order to grip the outer margins of the inner connecting band sections 24 in the vicinity of the lateral connecting webs 14, or the outer margins of the inner connecting band sections 24 may be gripped in the vicinity of the longitudinal connecting webs 16.

From the foregoing, it will be appreciated that the variable or tapering band width plastic multi-packaging device achieves uniform stress loading of the plastic bands thereof during elongation by semi-circular jaw members. The force loading and resulting elongation can well be understood by using an analogy of a double cantilever support beam system that is subjected to an increasing load whose direction varies between end loading and perpendicular with a constant load in between. The beam section must vary with changes in force loading if constant stress and a uniform rate of deflection are to result. Similarly, the uniform stress applied to the bands by the variable elongation and friction forces is controlled by the variable or tapering band width for the bands as disclosed herein.

I claim:

1. A multi-packaging device formed from stretchable and elastic plastic sheet material, comprising a plurality of bands arranged in longitudinal rows which are joined to adjacent bands between said longitudinal rows by lateral connecting webs and which are joined to adjacent bands in each longitudinal row by longitudinal connecting webs, each band having an inner curvilinear band section attached to a lateral connecting web which extends between adjacent longitudinal connecting webs and an outer curvilinear band section on the opposite side of the band from the inner curvilinear band section which also extends between said adjacent longitudinal connecting webs, and at least the outer curvilinear band section of each said band having predetermined uniform stress loading that is provided by a variable and tapering non-uniform band section configuration throughout which generally tapers from a maximum width in the vicinity of adjacent longitudinal connecting webs to a minimum width generally equidistant said longitudinal connecting webs, in order to establish uniform elongation throughout each band during stretching thereof.

2. The multi-packaging device as defined in claim 1 wherein the longitudinal connecting webs have a length less than the lateral connecting webs.

3. The multi-packaging device as defined in claim 2 wherein each of said bands have a longitudinal and lateral axis, and the dimension of two adjacent bands in one row in the vicinity of the longitudinal axis thereof being generally equal to the dimension of two adjacent bands in said longitudinal rows in the vicinity of the lateral axis thereof.

4. The multi-packaging device as defined in claim 3 wherein the dimension of two adjacent bands in the longitudinal rows in the vicinity of the marginal ends of the lateral connecting webs is greater than the dimension of two adjacent bands in one row in the vicinity of the marginal ends of the longitudinal connecting webs.

5. The multi-packaging device as defined in claim 4 wherein a diamond-shaped opening is provided in the area between two adjacent pairs of laterally and longitudinally connected bands.

* * * * *